US006123570A

United States Patent [19]

Hwang

[11] Patent Number: 6,123,570

[45] Date of Patent: Sep. 26, 2000

[54] FLAT CABLE CONNECTOR WITH STRAIN RELIEF ATTACHED THERETO BY PINS

[75] Inventor: Jeng-Yih Hwang, Irvine, Calif.

[73] Assignee: Hon Hai Precision Ind. Co., Ltd., Taipei Hsien, Taiwan

[21] Appl. No.: 09/302,635

[22] Filed: Apr. 29, 1999

[51] Int. Cl.[7] ..... H01R 13/58

[52] U.S. Cl. ..... 439/456; 439/466

[58] Field of Search ..... 439/404, 405, 439/456, 466, 468

[56] References Cited

U.S. PATENT DOCUMENTS 5,971,797 10/1999 Sttaub, Jr. et al. ..... 439/468

*Primary Examiner*—Lincoln Donovan
*Assistant Examiner*—Javaid Nasri
*Attorney, Agent, or Firm*—Wei Te Chung

[57] ABSTRACT

A flat cable connector includes a housing on which a cover is positioned. A strain relief is positioned on the cover to interpose a portion of a flat cable therebetween. A leading end of the flat cable is bent over the cover and interposed between the cover and the housing. Insulation displacement contact (IDC) elements are retained in the housing and pierce into wires of the flat cable to establish electrical connection therewith. Pins are mounted on the cover and extend through holes defined in the strain relief and the housing. Free ends of the pins are mechanically deformed to secure the strain relief and the cover to the housing. The pins may be integrally formed with the cover. Alternatively, the pins are replaced by rivets which extend through holes defined in the strain relief, the cover and the housing to rivet them together.

8 Claims, 4 Drawing Sheets

FLAT CABLE CONNECTOR WITH STRAIN RELIEF ATTACHED THERETO BY PINS

BACKGROUND OF THE INVENTION

1. Field of the Invention

The present invention generally relates to a flat cable connector, and in particular to a flat cable connector having a simplified structure.

2. The Prior Art

A flat cable connector connects a flat cable to an electrical device. To facilitate manufacturing, a flat cable is usually attached to a flat cable connector by means of an insulation displacement contact (IDC) technique. The connector comprises a housing in which IDC elements with sharpened edges are retained. A leading end of the flat cable is positioned on the housing with wires thereof corresponding to the sharpened edges of the IDC elements. A cover is then positioned on the wires and forcibly pressed toward the housing for forcing the wires to move relative to the IDC elements thereby causing the sharpened edges to pierce through insulative coatings of the wires and establishing electrical engagement with conductive cores of the wires.

Conventionally, latches are provided between the cover and the housing to secure them together. The latches have a complicated shape requiring a sophisticated molding and manufacturing process thereby increasing costs.

It is thus desired to have a flat cable connector having a simplified structure for overcoming the above problem.

SUMMARY OF THE INVENTION

Accordingly, an object of the present invention is to provide a flat cable connector having a simplified structure.

Another object of the present invention is to provide a flat cable connector having a low manufacturing cost.

A further object of the present invention is to provide a flat cable connector which is easy to assemble.

To achieve the above objects, a flat cable connector in accordance with the present invention comprises a housing on which a cover is positioned. A strain relief is positioned on the cover to interpose a portion of a flat cable therebetween. A leading end of the flat cable is bent over the cover and interposed between the cover and the housing. Insulation displacement contact (IDC) elements are retained in the housing and pierce into wires of the flat cable to establish electrical connection therewith. Pins are mounted on the cover and extend through holes defined in the strain relief and the housing. Free ends of the pins are mechanically deformed to secure the strain relief and the cover to the housing. The pins may be integrally formed with the cover. Alternatively, the pins are replaced by rivets which extend through holes defined in the strain relief, the cover and the housing to rivet them together.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
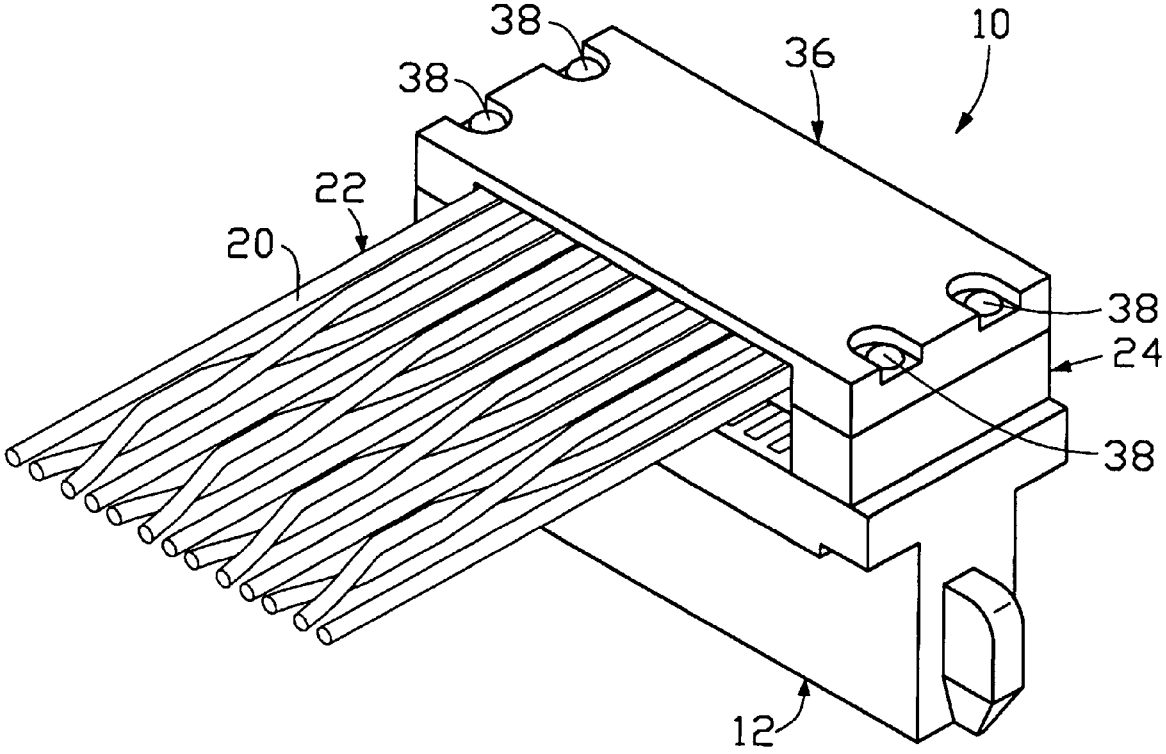
FIG. 1 is a perspective view of a flat cable connector constructed in accordance with a first embodiment of the present invention with a flat cable connected thereto.
Figure 2:
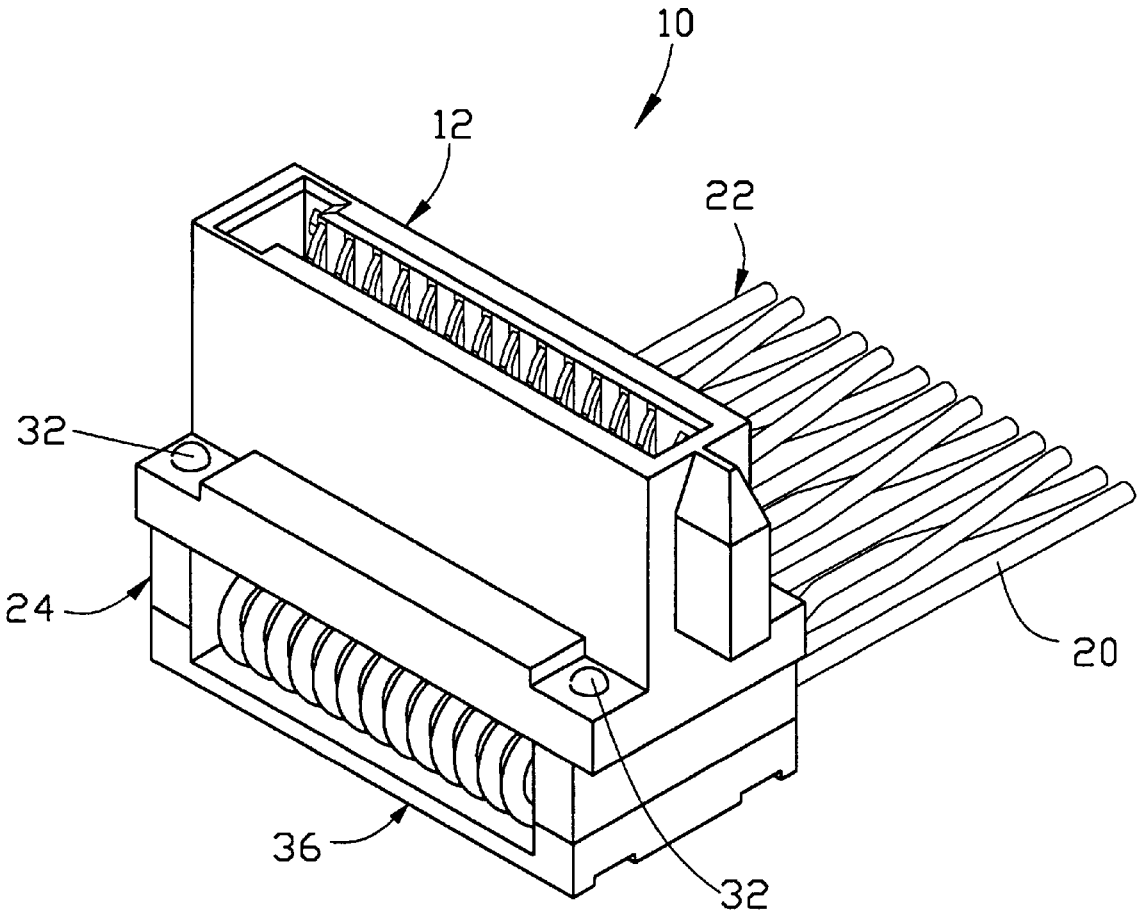
FIG. 2 is another perspective view of the flat cable connector of the present invention.
Figure 3:
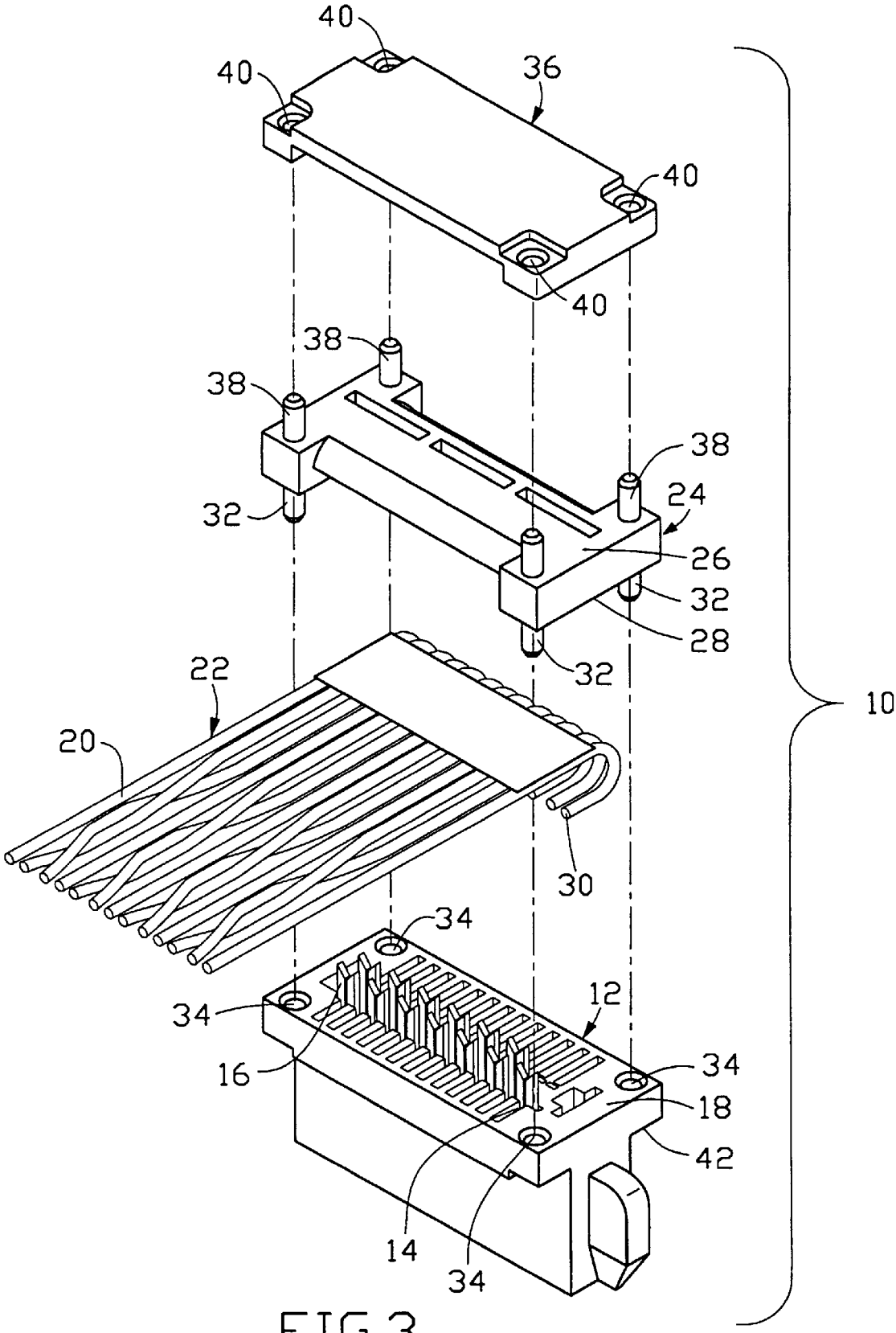
FIG. 3 is an exploded view of the flat cable connector of the present invention.

Referring to the drawings and in particular to FIGS. 1–3, a flat cable connector 10 in accordance with a first embodiment of the present invention comprises an insulative housing 12 defining a plurality of channels 14 for receiving insulation displacement contact (IDC) elements 16. Each IDC element 16 has two spaced arms (not labeled) having sharpened inner edges. The arms of the IDC elements 16 partially extend beyond a top face 18 of the housing 12 for supporting corresponding wires 20 of a flat cable 22.

A cover 24 has a top face 26 and an opposite bottom face 28. The flat cable 22 is positioned on the top face 26 with a leading end 30 thereof bent over the bottom face 28 as shown in FIG. 2. The bottom face 28 of the cover 24 is positioned on the top face 18 of the housing 12 with the leading end 30 of the flat cable 22 interposed between the bottom face 28 and the IDC elements 16. The cover 24 has a plurality of first pins 32 extending from the bottom face 28 thereof and received in corresponding holes 34 defined in the housing 12 for positioning purposes. By forcibly pressing the cover 24 toward the housing 12, the flat cable 22 is forced to move relative to the IDC elements 16 thereby causing the sharpened edges of the IDC elements 16 to pierce through insulative coatings of the corresponding wires 20 for establishing electrical engagement between the IDC elements 16 and the wires 20. In this respect, the first pins 32 also provide a guiding function.

A strain relief 36 is positioned on the top face 26 of the cover 24 for interposing the flat cable 22 therebetween. Second pins 38 extend from the top face 26 of the cover 24 and are received in holes 40 defined in the strain relief 36. Preferably, the second pins 38 are arranged to align with the first pins 32 as shown in FIG. 3.

The first pins 32 are sized to partially extend through the holes 34 of the housing 12 and free ends thereof extend beyond a bottom face 42 of the housing 12 when the cover 24 is pressed toward the housing 12. The free ends of the first pins 32 are mechanically deformed for being secured to the housing 12 as particularly shown in FIG. 2. Similarly, free ends of the second pins 38 extend beyond the strain relief 36 and are mechanically deformed for being secured to the strain relief 36 as particularly shown in FIG. 1.

Figure 4:
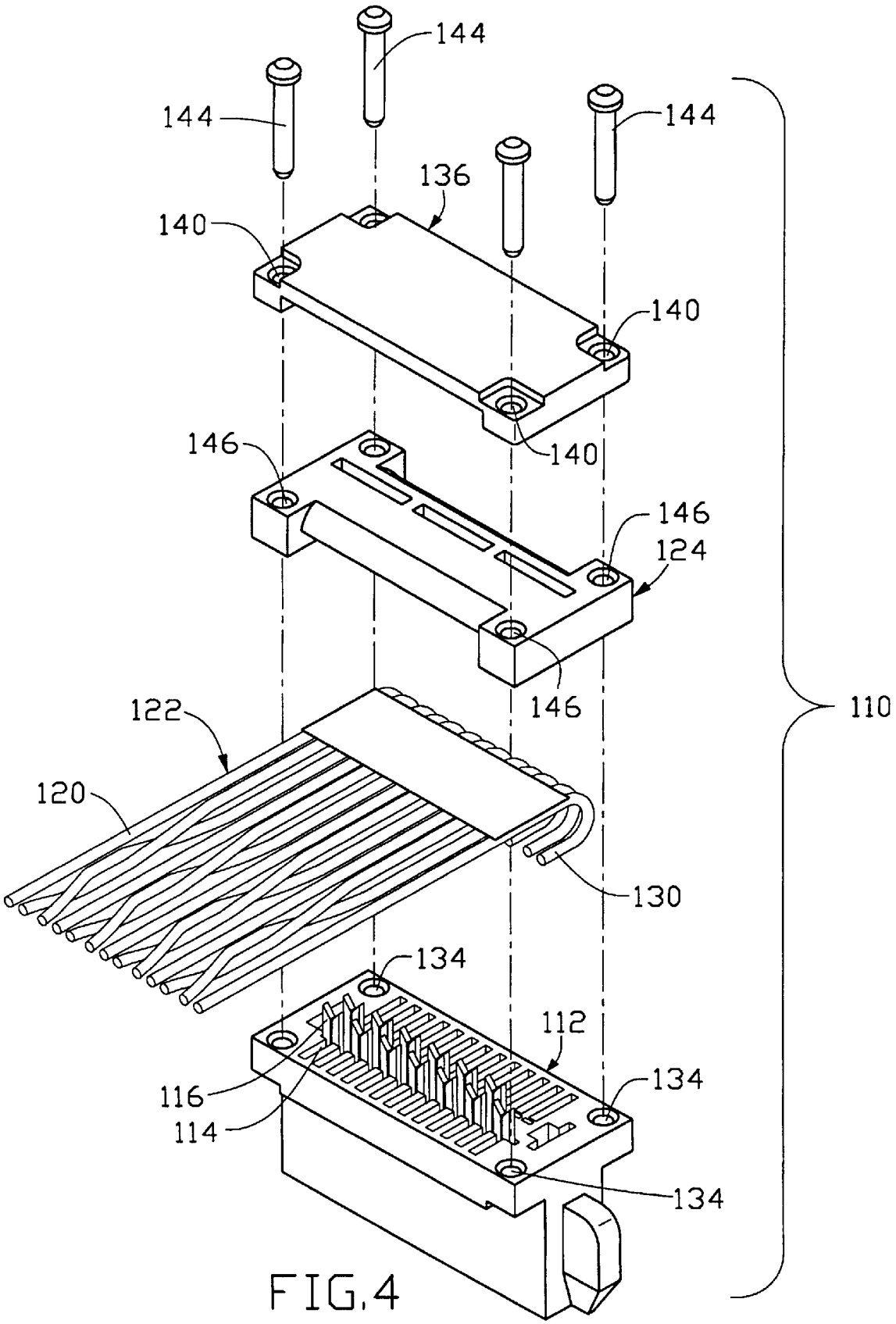
FIG. 4 is an exploded view of a flat cable connector constructed in accordance with a second embodiment of the present invention.

The first and second pins 32, 38 are integrally formed with the cover 24 and are made of the same material, such as plastic, as the cover 24 thereby simplifying the manufacturing process of the connector 10. However, the pins 32, 38 may be replaced by pins or rivets made of a durable material, such as metal, for more securely fixing the cover and the strain relief to the housing as illustrated in a second embodiment shown in FIG. 4.

A flat cable connector 110 in accordance with the second embodiment of the present invention comprises an insulative housing 112 defining channels 114 for retaining IDC elements 116 therein. A cover 124 is positioned on the housing 112 for interposing a leading end 130 of a flat cable 122 therebetween. The cover 124 is pressed toward the housing 112 thereby securing wires 120 of the flat cable 122 to the corresponding IDC elements 116. A strain relief 136 is positioned on the cover 124 to interpose a portion of the flat cable 122 therebetween. Pins 144 extend through holes 140, 146, 134 respectively defined in the strain relief 136, the cover 124 and the housing 112 with free ends thereof extending beyond the strain relief 136 and the housing 112 and mechanically deformed to secure the strain relief 136, the cover 124 and the housing 112 together. The pins 144 are preferably made of a durable material, such as metal. Preferably, the pins are rivets for riveting the strain relief 136, the cover 124 and the housing 112 together. The riveting operation also forces the cover 124 and thus the flat cable 122 to move relative to the housing 112 for establishing electrical connection between the IDC elements 116 and the wires 120 of the cable 122.

Although the present invention has been described with reference to the preferred embodiments, it is apparent to those skilled in the art that a variety of modifications and changes may be made without departing from the scope of the present invention which is intended to be defined by the appended claims.

What is claimed is:

1. A flat cable connector comprising:

a housing retaining IDC elements therein with the IDC elements partially extending beyond the housing;

a cover having a top face and an opposite bottom face positioned on the housing, and being adapted to interpose a leading end of a flat cable between the cover and the housing with wires of the flat cable engaged with the corresponding IDC elements, first and second pins respectively extending from the bottom and top faces of the cover, the first pins received in holes defined in the housing and partially extending beyond the housing for being mechanically deformed to secure the cover to the housing; and a strain relief positioned on the top face of the cover for interposing a portion of the flat cable therebetween, holes being defined in the strain relief for receiving the second pins of the cover, the second pins extending beyond the strain relief and being mechanically deformed to secure the strain relief to the cover.

2. The flat cable connector as claimed in claim 1, wherein the second pins are arranged to align with the first pins to form pin pairs.

3. The flat cable connector as claimed in claim 2, wherein each pin pair is formed by an elongate bar received in a hole defined in the cover.

4. The flat cable connector as claimed in claim 3, wherein the elongate bar is a rivet.

5. The flat cable connector as claimed in claim 1, wherein the first and second pins are integrally formed with the cover.

6. A flat cable connector comprising:

a housing retaining IDC elements therein with the IDC elements partially extending beyond the housing, first holes being defined in the housing;

a cover having a bottom face positioned on the housing and adapted to interpose a leading end of a flat cable between the cover and the housing with wires of the flat cable engaged with the corresponding IDC elements, second holes being defined in the cover corresponding to the first holes of the housing;

a strain relief being positioned on a top face of the cover for interposing a portion of the flat cable therebetween, third holes being defined in the strain relief corresponding to the second holes of the cover; and elongate bars extending through the first, second and third holes with ends thereof mechanically deformed to secure the strain relief, the cover and the housing together.

7. The flat cable connector as claimed in claim 6, wherein the elongate bars are rivets.

8. The flat cable connector as claimed in claim 6, wherein the elongate bars are retained in the second holes with opposite end portions thereof extending beyond the top and bottom faces of the cover for being received in the third and first holes of the strain relief and the housing, respectively.

* * * * *